US005938547A

United States Patent [19]

Gilford

[11] Patent Number: 5,938,547

[45] Date of Patent: Aug. 17, 1999

[54] BASKETBALL SHOT MAKING TRAINING DEVICE

[76] Inventor: Luther G. Gilford, 24201 Rensselaer, Oak Park, Mich. 48237

[21] Appl. No.: 09/075,045

[22] Filed: May 8, 1998

Related U.S. Application Data

[60] Provisional application No. 60/046,964, May 19, 1997.

[51] Int. Cl.[6] ..... A63B 69/00

[52] U.S. Cl. ..... 473/450

[58] Field of Search ..... 473/450

[56] References Cited

U.S. PATENT DOCUMENTS

| | | | |
|---|---|---|---|
| 4,993,707 | 2/1991 | Schwartz | 473/450 |
| 5,135,217 | 8/1992 | Swain | 473/450 |
| 5,271,617 | 12/1993 | Gilford | 473/450 |
| 5,582,402 | 12/1996 | Gilford | 473/450 |
| 5,816,910 | 10/1998 | Blevins | 473/450 |
| 5,833,233 | 11/1998 | Strug | 473/450 X |
| 5,865,695 | 2/1999 | Mahala et al. | 473/450 |

*Primary Examiner*—William H. Grieb
*Attorney, Agent, or Firm*—John R. Benefiel

[57] ABSTRACT

A basketball shot making training device having a forearm engaging frame, a pair of swing arms mounting a cradle-harness receiving a basketball. An adjustable spring mechanism resists movement of the swing arms as the user pushes the basketball outwardly with the wrist and finger motion. A strap harness network is adjustable to differently sized basketballs. The basketball is reversely rotated against a spring force as the user makes a simulated shot by wrist and hand motion.

12 Claims, 2 Drawing Sheets

BASKETBALL SHOT MAKING TRAINING DEVICE

CROSS REFERENCE TO RELATED APPLICATIONS

This application claims priority of provisional application Ser. No. 60/046,964 filed on May 19, 1997.

BACKGROUND OF THE INVENTION

This invention concerns training devices for improving a user's ability to make basketball shots. The present inventor has previously invented such devices, as described in U.S. Pat. No. 5,582,402 issued on Dec. 10, 1996 and U.S. Pat. No. 5,271,617 issued on Dec. 21, 1993.

These devices each involve an elongated member held on the user's forearm, with a resistance member pivotally mounted to one end. A hemispherical engagement piece is mounted on the resistance member to be engaged by the fingers and palm of the user. Pivoting of the resistance member away by execution of a wrist bending and finger-hand movement is restrained by a spring force such as to very effectively develop the user's strength in executing a motion very similar to that used in actual shot making.

In U.S. Pat. No. 5,582,402, the hemispherical piece is itself mounted to be able to rotate against resistance as the motion is executed to produce a more or less complete simulation of the shot making motion by allowing the hemispherical piece to undergo the reverse rotation normally induced in a basketball when a shot is made.

It is the object of the present invention to further improve this device by allowing an ordinary basketball to be used with the device, and also to simplify the components and make its structure less bulky.

SUMMARY OF THE INVENTION

The above recited objections achieved by providing a cradle-harness arrangement adapted to receive a basketball and releasably secure a basketball in position on a pair of resistance swing arms, each pivotally attached at one end to a framework adapted to be braced on a forearm of a user, with the fingers and palm of the hand engaging a basketball held in the cradle-harness arrangement.

A practice shot motion is executed by forcing the basketball outward with the engaging hand and fingers, the swing arms pivoting against the resistance of a spring force as the basketball moves out.

The basketball is also rotated reversely off the fingers of the engaging hand, the cradle-harness arrangement being pivotally mounted on the outer ends of the swing arms, and a spring resistance mechanism also provided resisting the cradle-harness arrangement pivoting motion.

The cradle-harness arrangement includes a curved cradle member on which the basketball rests, pivotally connected at either end to an end of each swing arm. A series of partially encircling flexible straps are secured to the cradle, one of which is adapted to be adjustably tightened to adapt the cradle-harness arrangement to securely hold differently sized basketballs.

The spring force exerted on the swing arms is adjustable, and is produced by a wound spring interposed between pairs of rotary elements connected respectively to one end of each swing arm and to a cradle member end. An adjusting screw carried by one of the rotary elements in each pair engages a wound spring and varies its preloading to adjust the spring resistance generated by pivoting of the swing arms.

DESCRIPTION OF THE DRAWING FIGURES

Figure 4:
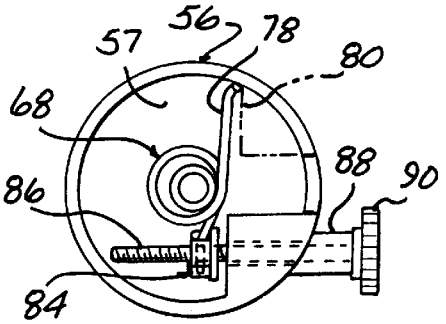
FIG. 4 is an enlarged side elevational view of the spring mechanism shown in FIG. 3.
Figure 4A:
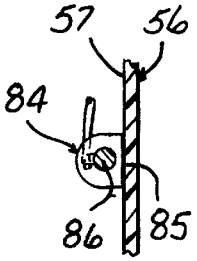

FIG. 4*a* is a fragmentary view of the drum.

Figure 5:
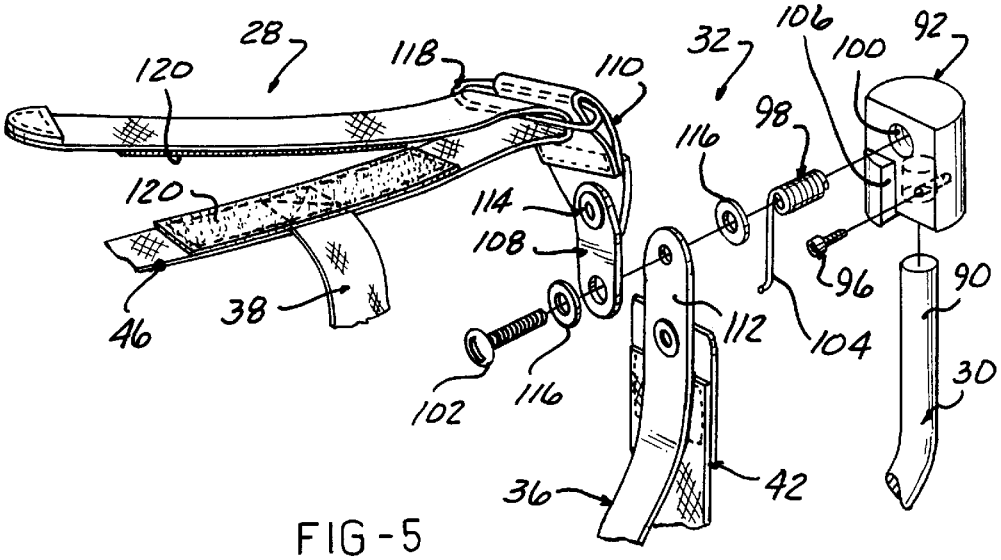

FIG. 5 is an enlarged exploded perspective view of one of the pivotal connections between the harness-cradle arrangement and the swing arms, with fragmentary portions of the straps, cradle member, and one swing arm.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
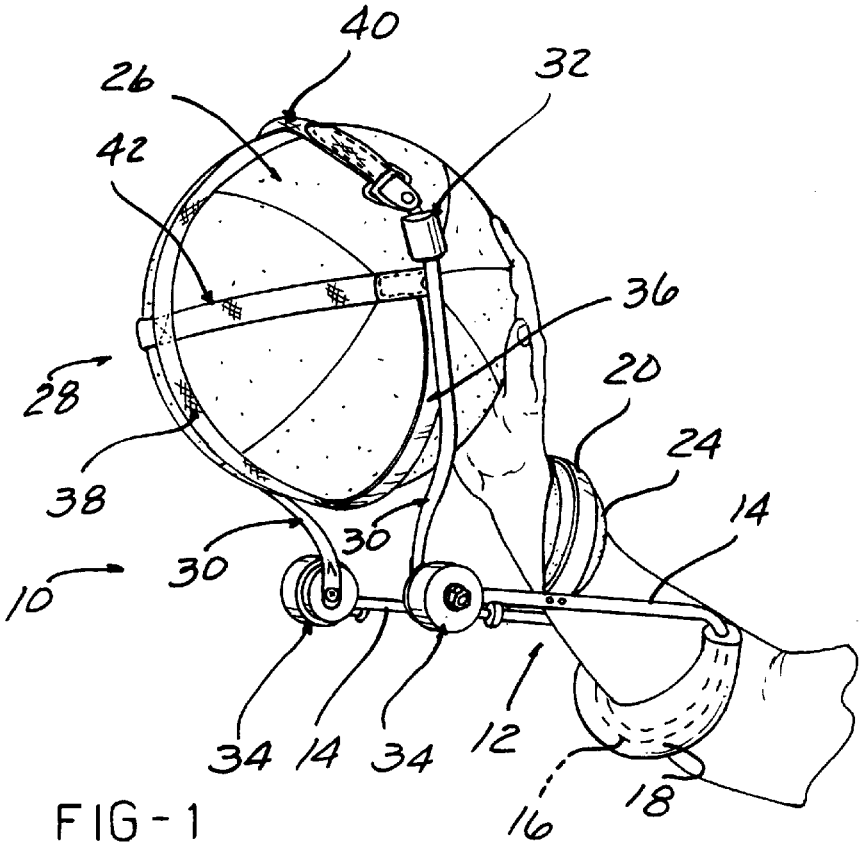
FIG. 1 is a perspective view of the basketball shot making training device according to the invention in use braced on the forearm of a user in the condition of the device at the beginning of the execution of a simulated shot.
Figure 2:
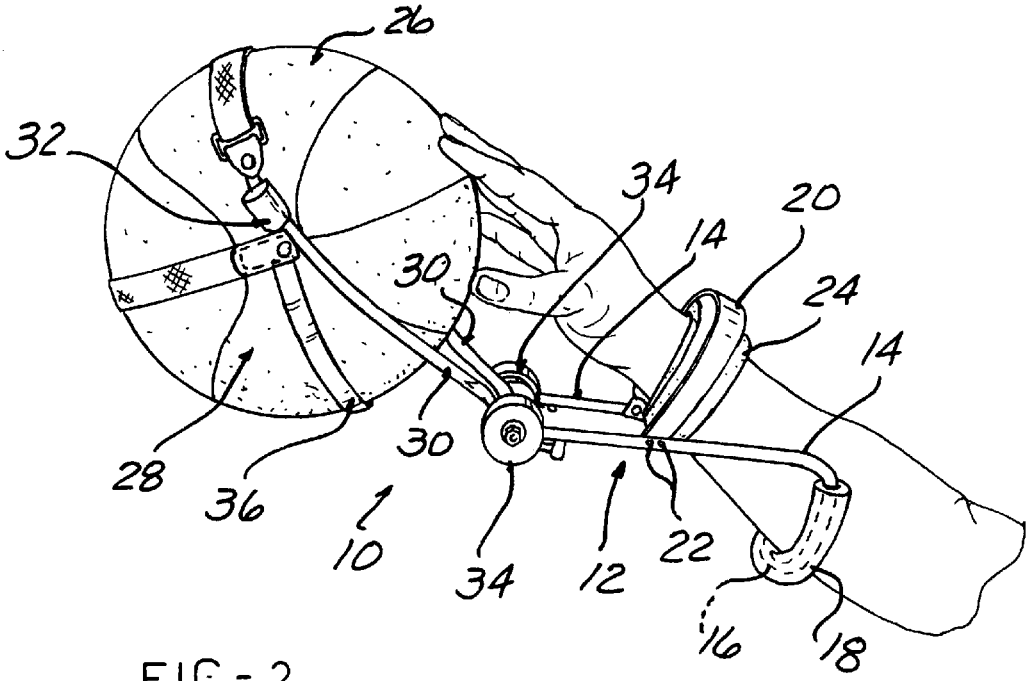
FIG. 2 shows the device of FIG. 1 in the condition of the device at the end of a simulated shot.

Referring to the Drawings, and particularly FIGS. 1 and 2, the basketball shot making training device 10 according to the present invention includes a frame support 12, comprised of a metal rod or tubing formed into a generally U-shaped piece having a pair of spaced apart legs 14 parallel and a concavely curved connecting end segment 16, covered with padding 18 to provide a first rest for the forearm of a user as shown.

A concavely curved cross strap 20 constructed of a strip of material such as aluminum extended across the U-shape, fixed at 22 to each leg 14 at an intermediate point along the length thereof. Padding 24 is provided on the inside of the cross strap to provide a rest for the wrist of the user.

The hand of the user is thereby placed in a position to engage a basketball 26 mounted in a cradle-harness arrangement 28 pivotally supported on the outer end of a pair of swing arms 30 by pivotal connections 32. A pivotal connection 34 mounts the inner end of each swing arm 30 to the end of a respective frame leg 14.

The reaction to the pushing of the user's hand against the basketball 26 tends to rotate the frame 12 about the strap 20, which is resisted by the engagement of the pad 18 with the user's forearm. This holds the frame 12 in position on the user's forearm, and provides a reaction anchor, allowing the basketball 26 to be pushed away with the user's hand as shown in FIG. 2.

The basketball 26 undergoes a reverse rotation as it is moved away by swinging of the swing arms 30, rolling off the fingers in a manner closely simulating an actual basketball shot.

These motions are resisted by spring forces to develop the strength of the muscles and tendons involved.

The cradle-harness arrangement 28 includes a cradle member 36 comprised of a downwardly curved metal strip 36 extending between the free ends of the swing arms 30, and on which the basketball 26 rests. A first woven flexible strap 38 extends from the center of the cradle member 36 to the center of a second flexible woven strap 40 extending from each swing arm outer end over the top of the basketball 26. Strap 38 is sewn to the center of strap 40 and riveted to the center of the cradle member 36.

A flexible woven cross strap 42 is attached to each swing arm end and extends across the front of the basketball 26 (strap 42 shown rotated down out of position in FIG. 5 for clarity).

Figure 3:
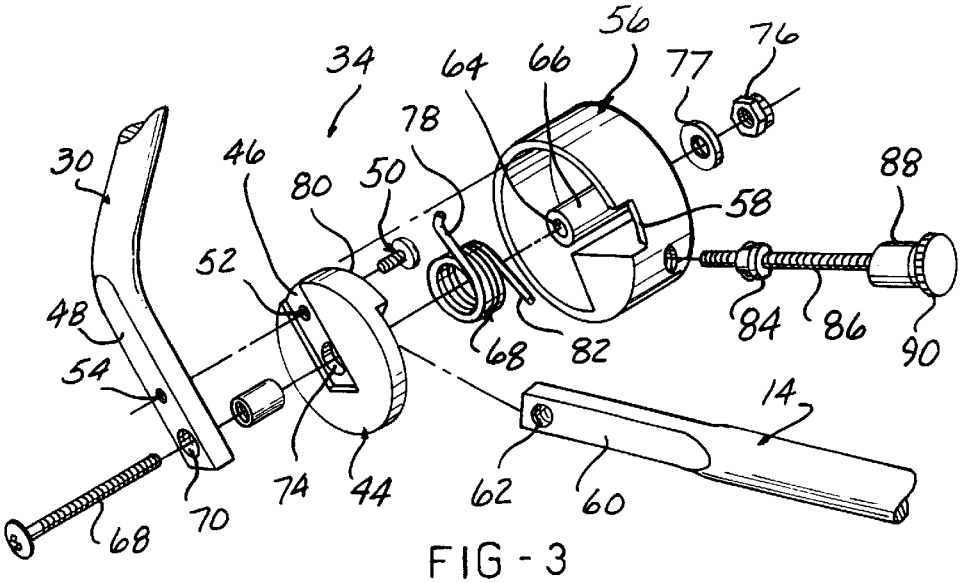
FIG. 3 is an exploded perspective view of one of the adjustable spring force mechanisms provided at the pivotal connection between the resistance arms and the cradle member of the device, with fragmentary portions of the swing arms and one end of the cradle member also shown in perspective.

FIG. 3 shows the details of the pivotal connection 34 with the associated adjustable spring mechanism.

These each include a disc 40 having a groove 46, receiving the flattened inner end 48 of the respective swing arm 30 by a groove. A screw 50 passing through a hole 52 is received in a threaded hole 54 in the end 48 to secure the disc 48 to the end 48.

A hollow cylindrical drum piece 56 open at one end has a slot 58 in one side receiving the flattened end 60 of the respective framework arm 14 with a hole 62 positioned over a hole 64 in an integral hub 66.

A helical wound spring 68 is received over the hub 66.

The disc 44 is secured on the open end of the drum piece 56 by a long screw 68 passing through a hole 70 in the swing arm end 48, a bushing 72, a hole 74 in the disc 44 and hole 64, with a locking nut 76 and washer holding everything together.

FIG. 4 shows that the wound spring 68 has a first winding end 78 engaging a protrusion 80 on the disc 42, and a second winding end 82 captured by a traveler nut 84 on an adjusting screw 86 protruding tangentially out from the side of drum piece 56. A stand off tube 88 positions a knurled head 90 for easy turning.

The preloading of the spring 68 to resist relative rotation of the disc 44 and drum 56 (and thereby swinging of swing arm 30) can be varied by travel of the nut 84 on the screw 86. The traveler nut 84 is flattened on one side 85 to about the inside surface 57 of the endwall of the drum piece 56 to be restrained against rotation (FIG. 4A).

The spring force causes the swing arms 30 to tend to assume a position on the pivotal connections 34 extending transversely to legs 14, i.e., approximately almost normal to the longitudinal axis of the frame, and to be movable by wrist and hand action of a user to an advanced position roughly aligned with the long axis of the frame 12, as seen in FIGS. 1 and 2.

FIG. 5 shows the pivotal connection for the cradle-harness arrangement 28 on the outer end 90 of the swing arm 30. This includes a molded plastic fitting 92 having a bore 94 receiving the swing arm end 90, a retaining screw 96 holding the fitting thereon.

A wound spring 98 is received in a bore 100 rotatable on a screw 102 threaded therein. An arm 104 engages a shoulder 106 protruding from one face of the fitting 92. The screw 102 also passed through one end of a limb 108 riveted at the other end 112 to a strap loop 110, as well as a respective end 112 of the cradle member 36. Washers 116 reduce friction during pivoting of limb 108 and cradle end 112.

This pivoting is resisted by wound spring 98.

The strap 46 is looped through a flattened ring 118 sewn into the strap loop 110, with mating VELCRO™ strips 120 allowing a length adjustment to be secured.

Accordingly, different sized basketballs, i.e., official mens', womens', etc., can be accommodated.

The device is less bulky than prior versions, using metal or small diameter composite rods or tubes and without a permanently attached hemispherical member.

An adjustable resistance mechanism allows varying effort to be adaptable to a progressive training regimen, and to the needs of each individual.

I claim:

1. A basketball shot making training device, comprising:

a frame configured to be fit to the forearm of a user, including a pair of elongated generally parallel spaced apart members, with a curved connecting end section at one end of said frame members, and an intermediate curved piece extending across a space between said members at a point intermediate the length thereof;

a pair of swing arms each having an inner and an outer end, each swing arm having a pivotal connection pivotally attaching said inner end thereof to an other end of a respective one of said frame members;

a basketball mounting arrangement pivotally connected to each outer end of each swing arm;

said basketball mounting arrangement including a network of straps able to be fit to a basketball to hold the same therein, said basketball engagable with the fingers and hand of a user having said frame in position on a forearm of said user; and, a resistance spring mechanism associated with each swing arm, each spring mechanism urging a respective swing arm towards a position on said associated pivotal connection extending transversely to said frame members.

2. The device according to claim 1 wherein each of said spring mechanisms including a wound spring and an adjustment screw engaging said wound spring to adjustably preload said spring with threaded movement thereof.

3. The device according to claim 1 wherein said basketball mounting arrangement comprises a cradle-harness arrangement including a concavely curved strip of rigid material comprising a cradle member supported at either end by said outer end of a respective swing arm, said cradle member adapted to allow a basketball to be rested thereon.

4. The device according to claim 1 wherein said network of straps includes a flexible strap able to be tightened to adjust to differently sized basketballs.

5. The device according to claim 1 wherein said basketball mounting arrangement is pivotally mounted to said swing arms.

6. The device according to claim 5 further including a spring on each swing arm outer end engaging said basketball mounting arrangement to resist pivotal movement thereon.

7. The device according to claim 3 wherein said network of straps includes a first strap extending from each end of said cradle member around the top of a mounted basketball, a second strip extending from each end of said cradle member and across the front of a mounted basketball.

8. The device according to claim 7 wherein said strap network further includes a third strap extending from the center of said cradle member to the center of said first strap.

9. The device according to claim 1 wherein said frame comprises a metal rod formed into a general U-shape to form said parallel frame members, a connecting end section concavely curved to be fit to a user's forearm.

10. The device according to claim 9 wherein a pad is mounted on said end section.

11. The device according to claim 1 wherein said pivotal connection between each of said swing arms and said respective frame members includes relatively rotatable elements connected to adjacent ends of said swing arms and from members, a wound spring interposed between said elements to resist relative rotation.

12. The device according to claim 11 further including a threaded screw having a traveling nut carried by one of said elements, an end of said spring captured by said nut to enable variable preloading of said spring to vary the resistance to rotation of said swing arms.

* * * * *